US010633903B2

(12) United States Patent
Benedetti et al.

(10) Patent No.: US 10,633,903 B2
(45) Date of Patent: Apr. 28, 2020

(54) HINGE FOR THE ROTATABLE MOVEMENT OF A DOOR, A SHUTTER OR THE LIKE

(71) Applicant: Colcom Group S.p.A., Nave (BS) (IT)

(72) Inventors: Luca Benedetti, Nave (IT); Mihai Mesaros, Nave (IT)

( * ) Notice: Subject to any disclaimer, the term of this patent is extended or adjusted under 35 U.S.C. 154(b) by 0 days.

(21) Appl. No.: 16/300,551

(22) PCT Filed: May 15, 2017

(86) PCT No.: PCT/IB2017/052842

§ 371 (c)(1),
(2) Date: Nov. 10, 2018

(87) PCT Pub. No.: WO2017/195180

PCT Pub. Date: Nov. 16, 2017

(65) Prior Publication Data

US 2019/0203515 A1 Jul. 4, 2019

(30) Foreign Application Priority Data

May 13, 2016 (IT) ..... 102016000049176
May 13, 2016 (IT) ..... 102016000049185
(Continued)

(51) Int. Cl.
*E05F 3/22* (2006.01)
*E05F 3/04* (2006.01)
(Continued)

(52) U.S. Cl.
CPC ..... *E05F 3/04* (2013.01); *E05D 3/02* (2013.01); *E05D 5/10* (2013.01); *E05D 5/14* (2013.01);
(Continued)

(58) Field of Classification Search
CPC ..... E05F 3/104; E05F 3/10; E05F 3/20; E05F 3/225; E05F 3/227; E05F 3/04;
(Continued)

(56) References Cited

U.S. PATENT DOCUMENTS 4,847,946 A * 7/1989 Nam ..... E05F 3/102 16/53
5,090,089 A * 2/1992 Schulte ..... E05F 3/04 16/49
(Continued)

FOREIGN PATENT DOCUMENTS

| | | |
|---|---|---|
| DE | 19812364 | 9/1999 |
| EP | 2397635 | 12/2011 |
| WO | 2015159256 | 10/2015 |

*Primary Examiner* — Chuck Y Mah
(74) *Attorney, Agent, or Firm* — Themis Law

(57) ABSTRACT

A hinge for the rotatable movement of a closing element, such as a door, a window, a shutter or the like, between a closing position and an opening position, the closing element being anchorable to a stationary support structure, such as a wall, a floor, a frame or similar, includes a hinge body anchorable to the stationary support structure or the closing element, and a pivot defining an axis and anchorable to the closing element or the stationary support structure. The pivot and the hinge body are coupled so as to cause the closing element to rotate between the opening and the closing position. The hinge body includes a working chamber defined along the axis to house the pivot.

15 Claims, 14 Drawing Sheets

(30) Foreign Application Priority Data

May 13, 2016 (IT) ..... 102016000049196
May 13, 2016 (IT) ..... 102016000049206

(51) Int. Cl.

| | |
|---|---|
| ***E05D 3/02*** | (2006.01) |
| ***E05D 9/00*** | (2006.01) |
| ***E05D 5/14*** | (2006.01) |
| ***E05D 5/10*** | (2006.01) |
| ***E05D 11/00*** | (2006.01) |
| ***E05D 11/02*** | (2006.01) |

(52) U.S. Cl.
CPC ..... *E05D 9/005* (2013.01); *E05D 11/0054* (2013.01); *E05D 11/02* (2013.01); *E05Y 2201/212* (2013.01); *E05Y 2800/676* (2013.01); *E05Y 2900/132* (2013.01); *E05Y 2900/146* (2013.01); *E05Y 2900/148* (2013.01)

(58) Field of Classification Search
CPC ..... E05Y 2201/638; E05Y 2800/268; E05Y 2800/676; E05Y 2900/132; E05Y 2900/146; E05Y 2900/148; E05Y 2600/452; E05Y 2600/41; E05Y 2201/212; E05D 7/086; E05D 7/10; E05D 3/02; E05D 5/10; E05D 5/14; E05D 9/005; E05D 11/0054; E05D 11/02; Y10T 16/552; Y10T 16/5525; Y10T 16/56; Y10T 16/593; Y10T 16/2769; Y10T 16/2771; Y10T 16/2774; Y10T 16/283; Y10T 16/304
See application file for complete search history.

(56) References Cited

U.S. PATENT DOCUMENTS

| | | | | |
|---|---|---|---|---|
| 6,161,255 | A * | 12/2000 | Garrett | A47K 3/36 16/284 |
| 6,823,561 | B2 * | 11/2004 | Park | E05F 3/00 16/320 |
| 9,074,399 | B2 * | 7/2015 | Cheng | E05F 3/104 |
| 9,989,119 | B2 * | 6/2018 | Oberender | F16F 9/38 |
| 2002/0133904 | A1 * | 9/2002 | Donovan | E05F 3/16 16/49 |
| 2004/0206007 | A1 * | 10/2004 | Chiang | E05D 5/0246 49/388 |
| 2005/0177975 | A1 * | 8/2005 | Wang | E05F 1/1292 16/60 |
| 2006/0123598 | A1 * | 6/2006 | Park | E05F 3/02 16/378 |
| 2007/0033768 | A1 * | 2/2007 | Ginzel | E05F 3/04 16/71 |
| 2007/0228742 | A1 * | 10/2007 | Chiang | E05D 5/0246 292/163 |
| 2011/0219583 | A1 * | 9/2011 | Bacchetti | E05D 11/1014 16/54 |
| 2012/0174339 | A1 | 7/2012 | Novin | |
| 2012/0311817 | A1 * | 12/2012 | Bacchetti | E05D 7/081 16/51 |
| 2014/0075718 | A1 * | 3/2014 | Bacchetti | E05F 3/104 16/54 |
| 2015/0121653 | A1 * | 5/2015 | Bacchetti | E05F 3/104 16/54 |
| 2016/0017648 | A1 * | 1/2016 | Petrelli | E05D 7/08 16/284 |
| 2017/0030125 | A1 * | 2/2017 | Bacchetti | E05F 3/10 |
| 2018/0283073 | A1 * | 10/2018 | Bacchetti | E05D 5/0246 |

* cited by examiner

HINGE FOR THE ROTATABLE MOVEMENT OF A DOOR, A SHUTTER OR THE LIKE

FIELD OF THE INVENTION

The present invention is generally applicable in the technical field of the control or closing hinges, and it relates in particular to a hinge for the rotatable movement of a door, a shutter or the like.

BACKGROUND OF THE INVENTION

Hinges comprising a box-shaped hinge body and a pivot each other reciprocally coupled in order to allow a closing element, such as a door, a shutter or the like, to rotate between an open position and a closed position.

Said known hinges include also a working chamber within the box-shaped hinge body which houses the pivot.

Said hinges are susceptible to improvements, in particular for what concerns the cost and the simplicity in mounting thereof.

SUMMARY OF THE INVENTION

Object of the present invention is to at least partially overcome the above drawbacks, by providing a hinge having features of high functionality and cost-effectiveness.

Another object of the invention is to provide a hinge of compact dimensions.

Another object of the invention is to provide an extremely safe hinge.

Another object of the invention is to provide a hinge extremely easy to install.

Another object of the invention is to provide a hinge extremely easy to mount.

Another object of the invention is to provide a hinge of an extremely long durability.

Said objects, and others that will appear more clearly hereinafter, are fulfilled by a hinge according with what herein described and/or claimed and/or shown.

Advantageous embodiments of the invention are defined in the dependent claims.

BRIEF DESCRIPTION OF THE DRAWINGS

Further features and advantages of the invention will become more apparent by reading the detailed description of some preferred but not exclusive embodiments, shown as a non-limiting example with the help of the attached drawings in which.

DETAILED DESCRIPTION OF SOME PREFERRED EMBODIMENTS

Figure 1:
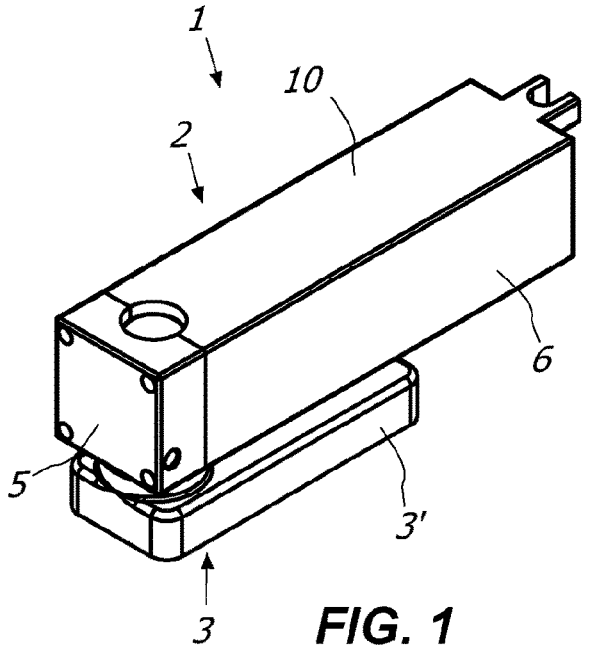
FIG. 1 is an axonometric view of a first embodiment of the hinge 1.
Figure 2:
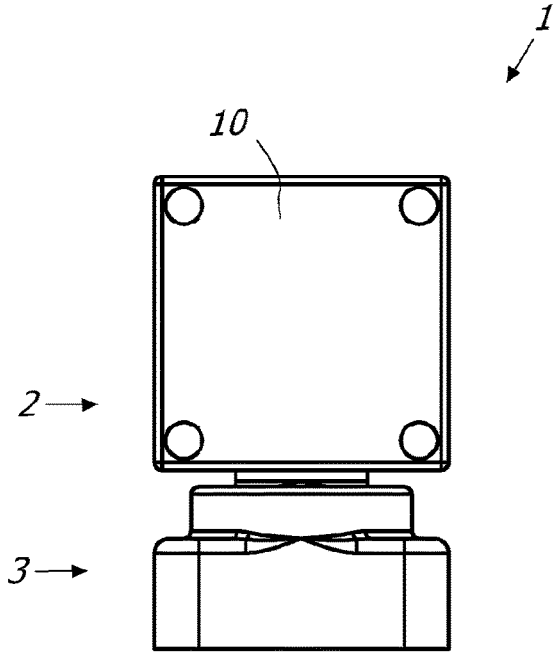
FIG. 2 is a front view of the hinge 1 of FIG. 1.
Figure 3:
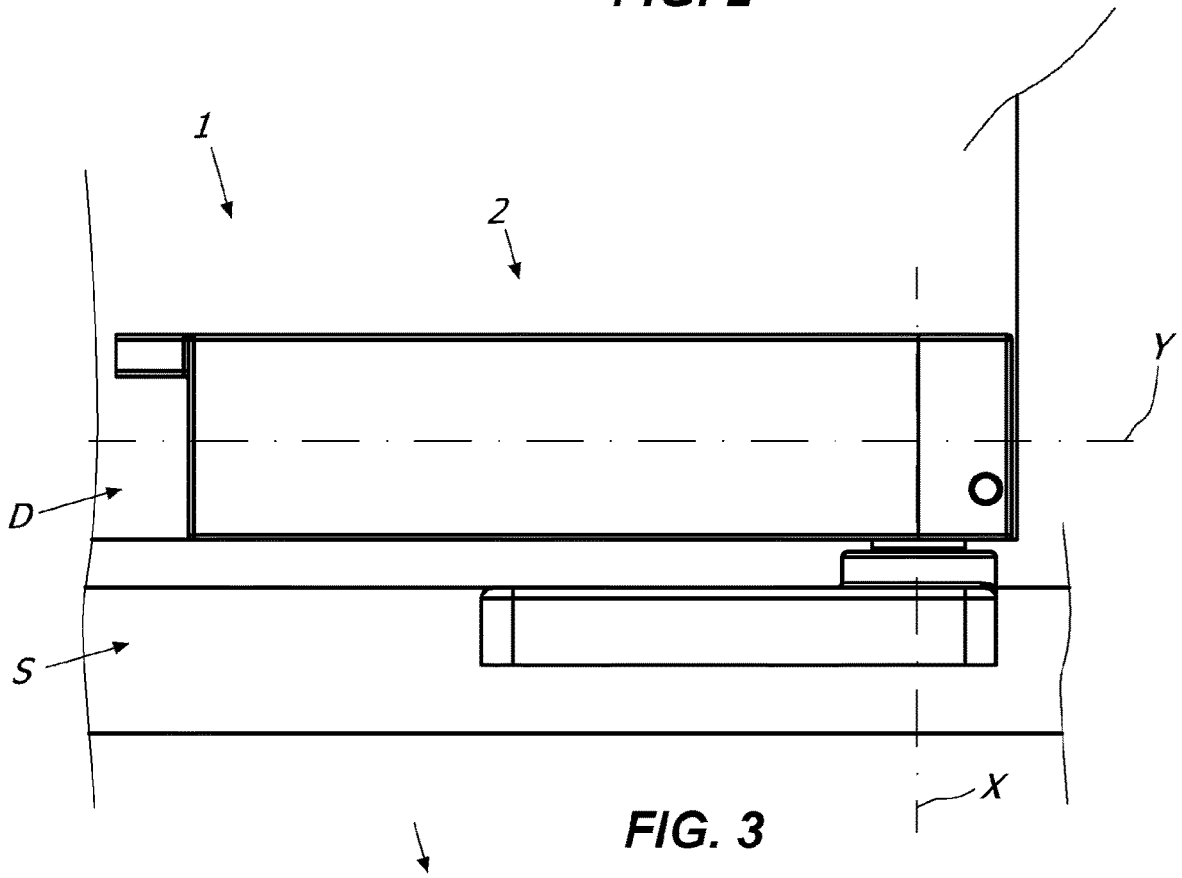
FIG. 3 is a schematic lateral view of the hinge 1 coupled with a support structure S e and with a closing element D.
Figure 4:
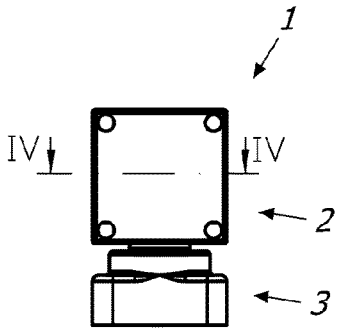
FIGS. 4 and 5 are front views of the hinge 1 in different operational steps.

Referring to the mentioned drawings, it is described a hinge 1 particularly useful for the rotatable movement and/or control of at least one closing element D, such as a door, a shutter, a gate or the like, which is anchorable to a stationary support structure S, such as a wall and/or a frame of a door or of a window and/or a support pillar and/or the floor.

In particular, the closing element D may rotate between at least one closed position and at least one open position.

It is understood that depending on the configuration, the hinge 1 may allow the automatic opening and/or closing of the closing element D and/or the control during the opening and/or closing of the closing element D itself.

The hinge 1 may then comprise one elongated fixed element 2 defining an axis Y anchorable to one between the stationary support structure S and the closing element D and at least one movable element 3 defining an axis X anchorable to the other between the stationary support structure S and the closing element D.

Conveniently, as better explained hereinafter, the movable element 3 and the fixed element 2 are reciprocally anchorable to rotate around one longitudinal axis X between one open position and one closed position.

For example, as particularly shown in the appended figures, the movable element 3 may comprise one elongated hinge body 10 defining an axis Y, while the fixed element 2 may comprise at least one pivot 20 defining the axis X which may be anchored to the other between the stationary support structure S and the closing element D, for example through the base 3'.

Figure 5:
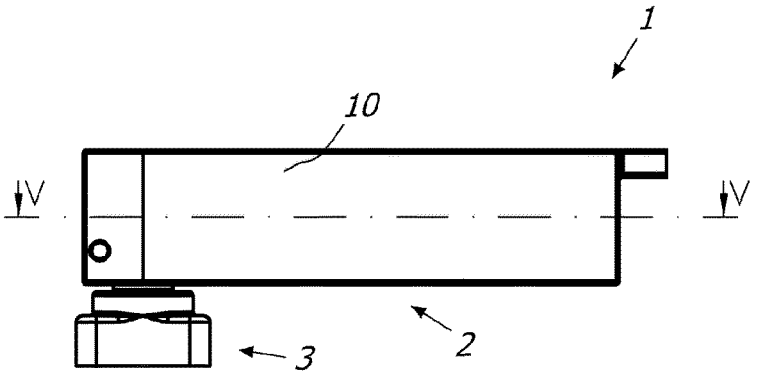
Figure 6:
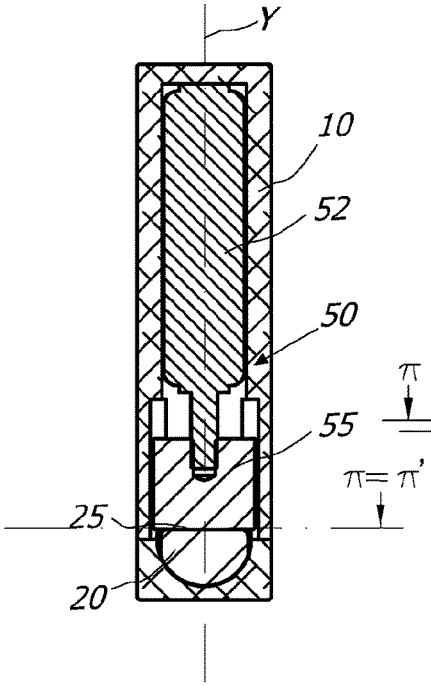
FIGS. 6 and 7 are sections taken along the planes IV-IV and V-V of respectively FIG. 4 and FIG. 5.
Figure 7:
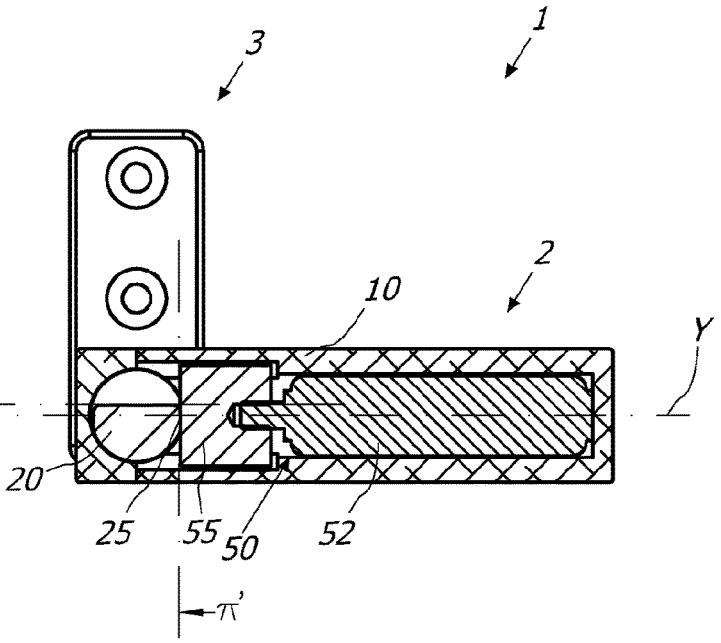

As particularly shown in the FIGS. 4, 5, 6 and 7, the pivot 20 and the hinge body 10 may be rotationally coupled so that the reciprocal rotation of the latter corresponds to the rotation of the closing element D between the closed position (FIGS. 4 and 6) and the open position (FIGS. 5 and 7).

Conveniently, the hinge body 10 may at least include one first working chamber 11 placed along the axis X to house the pivot 20.

In particular, the first working chamber 11 may at least include an inner surface 12 comprising at least one first support portion 13 susceptible to be loaded by the pivot 20 during the rotation thereof.

Conveniently, the hinge 1 may then comprise anti-friction means 30 being interposed between the support portion 13 and the pivot 20. Said anti-friction means 30 may be of known type, such as bearings, bushings or similar anti-friction means.

In a preferred but not exclusive embodiment of the invention, the support portion 13 may comprise at least one layer made of an anti-friction polymeric material so as to define the anti-friction means 30. In particular, the support portion 13 may be entirely made of said anti-friction polymeric material.

The anti-friction polymeric material may be a thermoplastic polymer, possibly of the self-lubricating type. For example, said material may be fibers-filled polyamide with a solid lubricant additive.

The inner surface 12 of the first working chamber 11 may also comprise at least one second support portion 14 opposed to the first support portion 13 susceptible to be loaded by the pivot 20.

Conveniently, also the second support portion 14 may be made of an anti-friction polymeric material, it may preferably be the same polymeric material as that used to make the first support portion 13.

According to another aspect of the invention, all the inner surface 12 of the first working chamber 11 may at least comprise one layer made of said anti-friction polymeric material.

Figure 8:
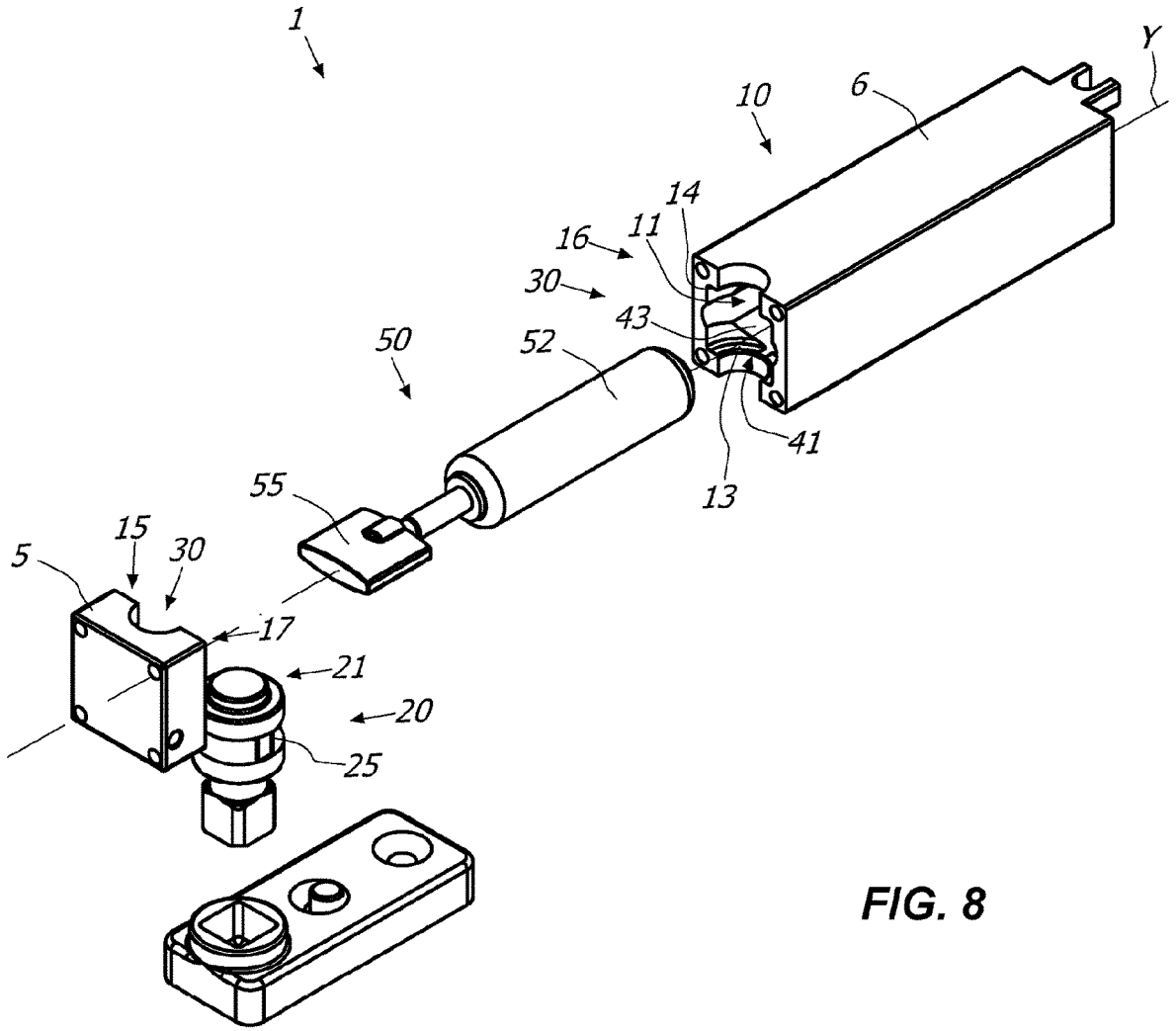
FIG. 8 is an exploded view of the embodiment of the hinge 1 shown in the FIGS. from 4 to 7.
Figure 9:
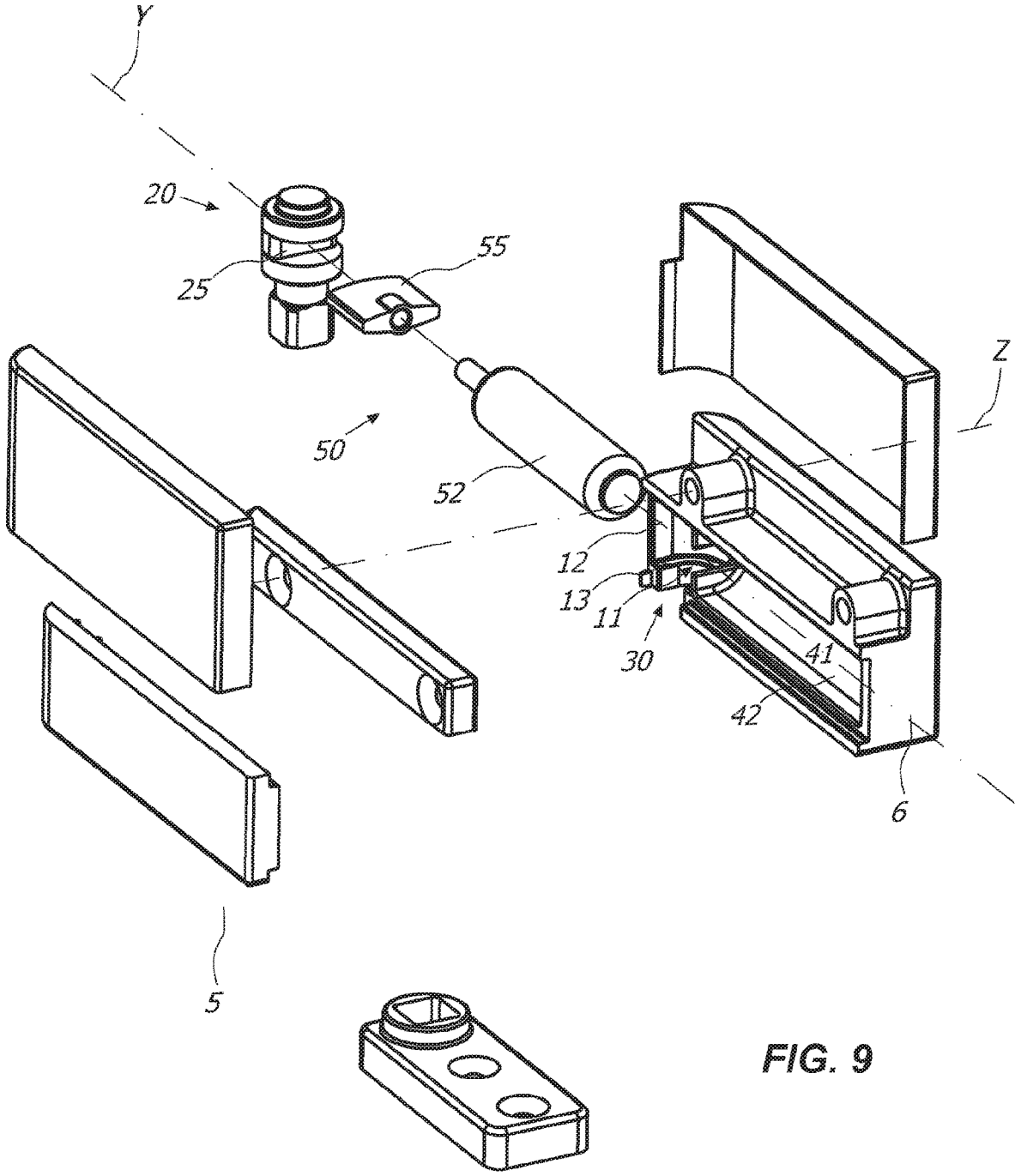
FIG. 9 is an exploded view of a different embodiment of the hinge 1.

Possibly, as particularly shown in the FIGS. 8 and 9, the first working chamber 11 may be entirely made of said anti-friction polymeric material so as to avoid using bearings, bushings or similar anti-friction means external to the first working chamber 11 itself.

Thanks to said feature, the hinge 1 may have a reduced number of pieces, a lower manufacturing cost and a higher mounting simplicity.

Furthermore, as particularly shown in FIG. 8, the hinge 1 may comprise at least a pair of half-shells 5, 6 that may be each other reciprocally coupled. In particular, the half-shell 5 may comprise one first half portion 15 of the first working chamber 11, while the other half-shell 6 may include one second half portion 16 of the first working chamber 11.

In such a way, the mounting of the hinge 1 may be done by coupling the half-shells 5, 6 with the interposition of the pivot 20 between the first half-portion 15 and the second half-portion 16 of the first working chamber 11.

In particular, the half-shells 5, 6 may be coupled by sliding along the axis Y as shown in the FIGS. 1, 2, 3, 8 and 11 or along one axis Z transverse thereto as shown in FIG. 9.

Figure 11:
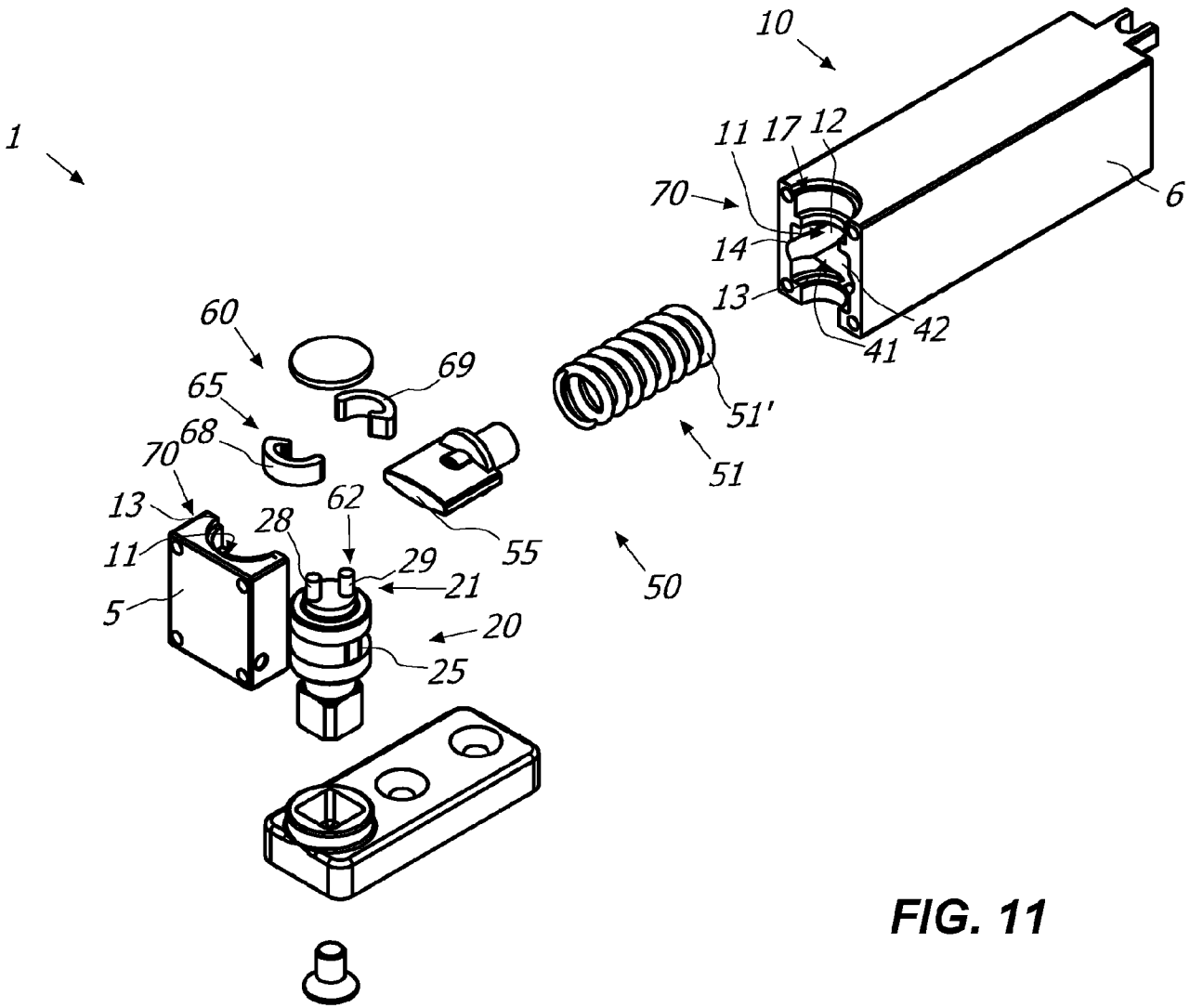
FIG. 11 is an exploded view of another embodiment of the hinge 1 comprising braking means 60.
Figure 12:
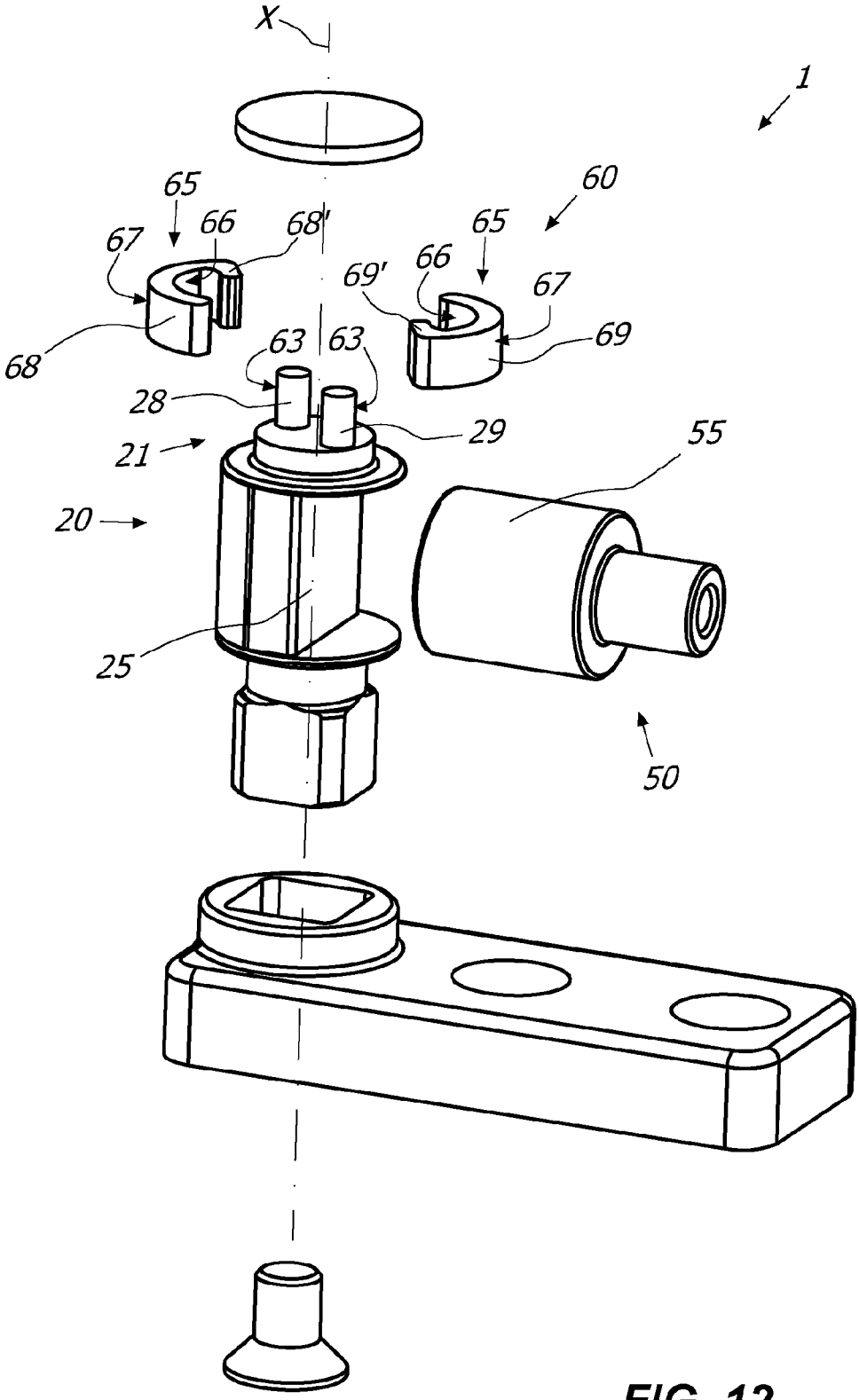
FIG. 12 is an exploded view of some elements of another embodiment of the hinge 1 comprising braking means 60.
Figure 13:
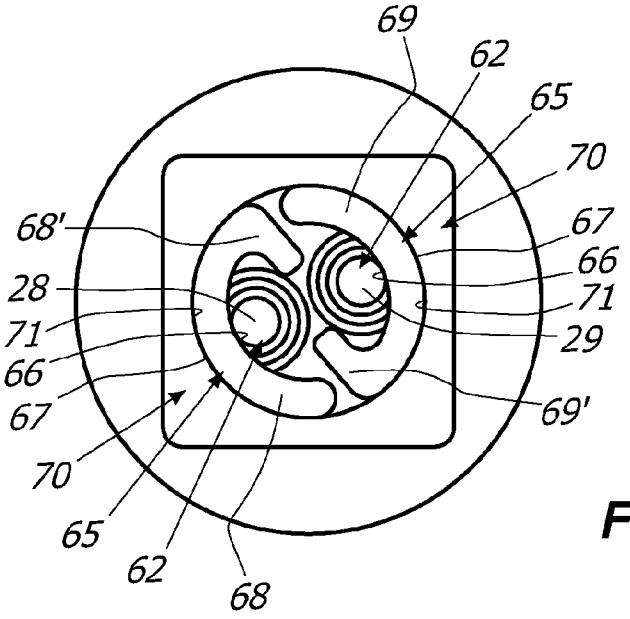
FIG. 13 is a top view of some elements of the hinge 1 of FIG. 11.

In another embodiment of the invention, shown for example in the FIGS. 11, 12 and 13, the hinge 1 may also include braking means 60 to mechanically brake the rotatable movement of the closing element D during the opening and/or closing thereof.

In particular, said braking means 60 may comprise at least one cam element 62 integrally rotating around the axis X with the pivot 20 and at least one follower element 65 interacting with the cam element 62 to radially move during the rotation of the latter.

The braking means 60 may also comprise at least one counteracting element 70 integral with the hinge body 10 and interacting with the follower element 65 to abut against the latter upon its radial movement.

The cam element 62 and the contrast element 70 may be reciprocally facing. In particular, as illustrated in FIG. 11, the cam element 62 may be placed at one end 21 of the pivot 20 which may be faced to a corresponding end 17 of the working chamber 11.

As particularly shown in FIG. 13, the follower element 65 may be interposed between the cam element 62 and the counteracting element 70, which may be monolithic with the working chamber 11 or coupled therewith.

In particular, the counteracting element 70 may be integrally coupled with the end 17 of the working chamber 11.

Figure 18:
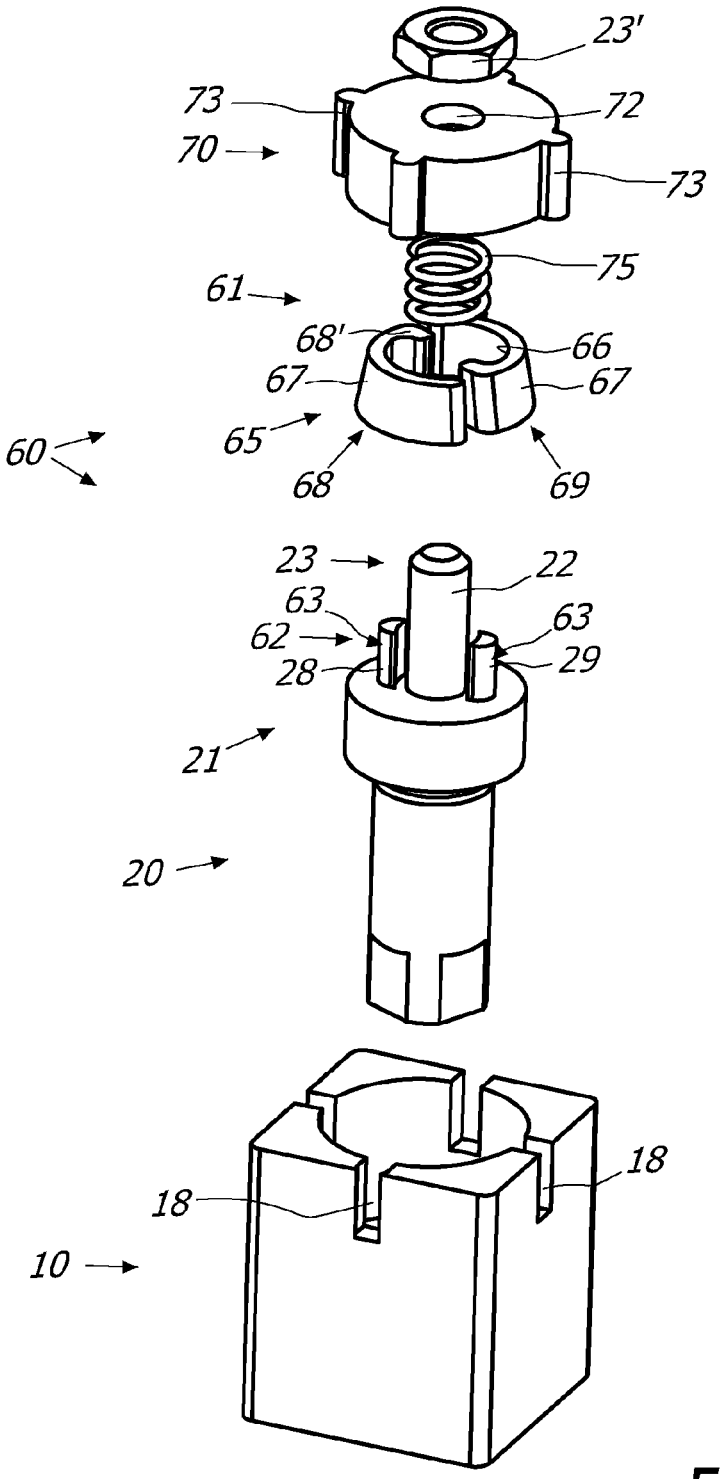
FIG. 18 is an exploded view of some elements of the hinge 1 shown in the FIGS. 14 to 17.

More in particular, the counteracting element 70 may be coupled to the hinge body 10, as shown for example in FIG. 18, or may be monolithic therewith as shown in FIGS. 8 and 11. In such latter case, the inner surface 12 of the first working chamber 11 may define the first working surface 71 of the counteracting element 70.

The follower element 65 may comprise one first working surface 66 interacting or in contact with a first working surface 63 of the follower element 62 and one second working surface 67 opposed to the first working surface 66 interacting or in contact with one first working surface 71 of the counteracting element 70.

Conveniently, the follower element 65 may move in a plane $\pi 3$ substantially perpendicular to the axis X. In particular, the cam element 62, the follower element 65 and the counteracting element 70 may be reciprocally configured so that the cam element 62 by rotating around the axis X promotes the pushing of the follower element 65 against the counteracting element 70 so that the latter reacts against the former via the second.

In this way it may be obtained an effective braking action.

More in detail, the cam element 62 may comprise at least one pushing element 28 of substantially cylindrical shape parallel to axis X eccentrically rotating with respect thereto. For example, the pushing element 28 may be integrally coupled or monolithic with the pivot 20, preferably it may be placed in correspondence of the end 21 thereof.

The follower element 65 may comprise at least one substantially "C" shaped element 68.

Conveniently, the working surface 71 of the counteracting element 70 may be substantially cylindrical while the shaped element 68 may have at least one portion 68', for example an end portion, having a depth greater in correspondence to the open position of the closing element so as to brake it during the opening.

In other words, after the rotation of the pivot 20 and then of the pushing element 28, the shaped element 68 is compressed against the working surface 71 of the counteracting element 70 so as to make integral each other the elements 28, 68, 70 and prevent the continuation of the rotation. That is a braking action is obtained.

Possibly, as shown for example in the FIGS. 11 and 12, the cam element 62 may comprise a pair of pushing elements 28, 29 placed in correspondence to the ends 21 of the pivot 20 at opposite sides with respect to the axis X, while the follower element 65 may comprise a pair of shaped elements 68, 69.

In particular, the pushing elements 28, 29 may interact with the respective shaped element 68, 69 to push it against the working surface 71 of the counteracting element 70.

Depending on the configuration of said shaped elements 68, 69, and/or depending on the orientation thereof, that is depending on the positioning of the respective portion with greater depth 68' 69' with respect to the rotation direction, it may have a braking action during the opening or the closing of the closing element D.

Possibly, the cam element 62, the follower element 65 and the counteracting element 70 may be reciprocally configured so as to differentiate the action of the braking means 60 during the opening and the closing of the closing element D.

According to a particular embodiment of the invention, shown for example in the FIGS. from 14 to 18, the hinge 1 may comprise means for the adjustment 61 of the intensity of the braking action of the braking means 60.

In particular, the second working surface 67 of said follower element 65 and the working surface 71 of the counteracting element 70 may be reciprocally in contact and inclined.

Figure 15:
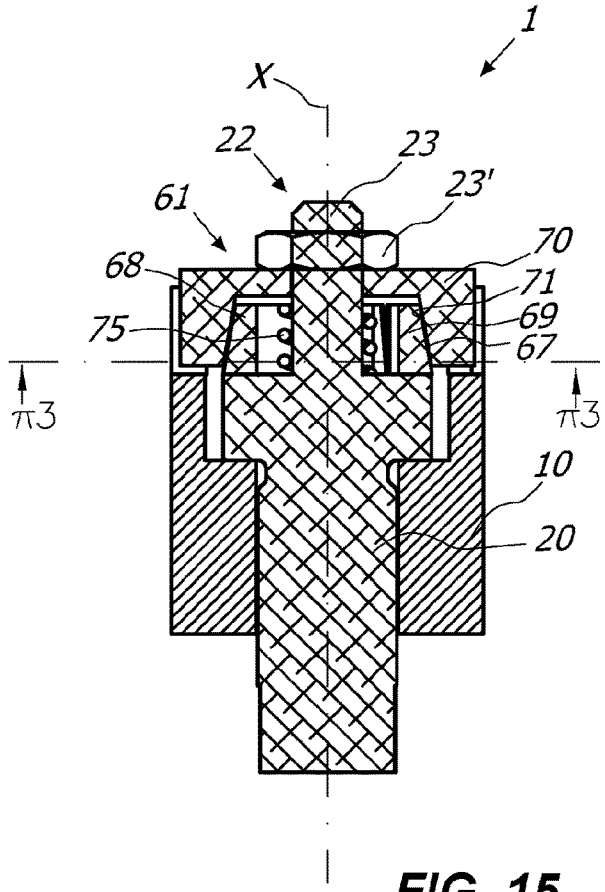
FIGS. 15 and 17 are sections taken along the planes XIV-XIV and XVI-XVI of respectively FIG. 14 and FIG. 16.
Figure 16:
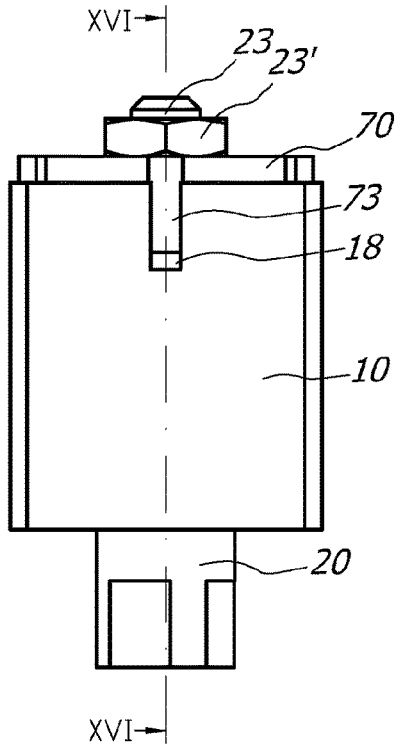
Figure 17:
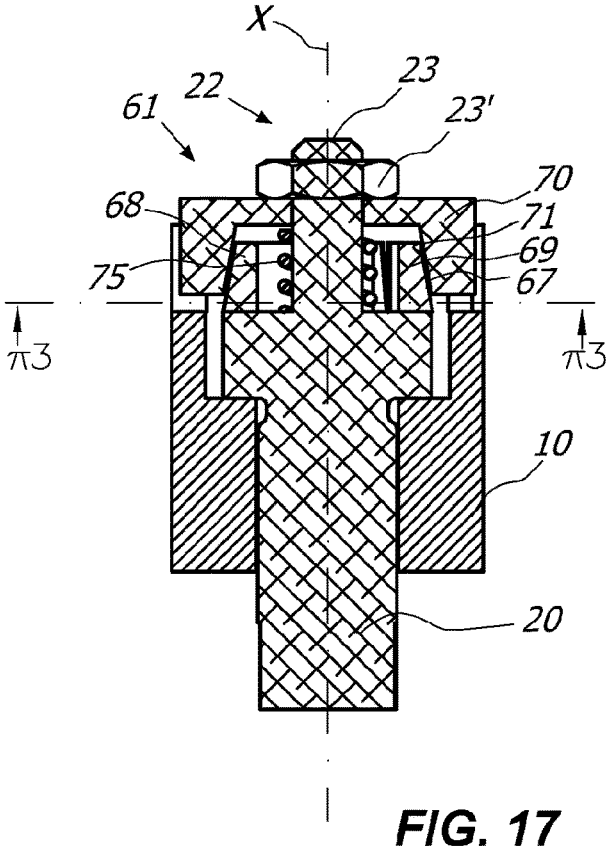

Conveniently, as particularly shown in the FIGS. 15 and 17, the counteracting element 70 may be slidable along the axis X to allow the adjustment of the braking means 60.

As particularly shown in FIG. 18, the end 21 of the pivot 20 may comprise a cylindrical projection 22 extending along the axis X which may present at least one threaded portion 23. On the other side, the hinge 1 may comprise at least one counterthreaded nut 23' with respect to the threaded portion 23 of the cylindrical projection 22.

Conveniently, the counteracting element 70 may comprise a through hole 72 for the cylindrical projection 22. Once inserted the first onto the second, the threaded portion 23 may protrude with respect to the counteracting element 70 so that by screwing the nut 23' it is possible to block the sliding along the axis X of the counteracting element 70.

In particular, the latter may slide along the axis X after the screwing/unscrewing of the nut 23' so as to adjust the intensity of the braking action of the braking means 60.

Conveniently, as shown in the FIGS. 15, 17 and 18, an elastic element 75 may be foreseen, for example a spring, interposed between the end 21 of the pivot 20 and the working surface 71 of the counteracting element 70 so as to force the latter towards the nut 23' and then block its axial sliding.

Figure 19:
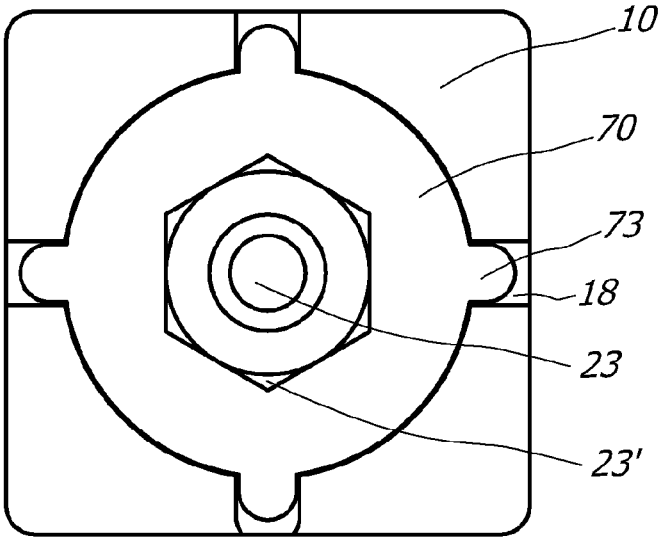
FIG. 19 is a top view of some elements of the hinge 1 shown in the FIG. 18.
Figure 14:
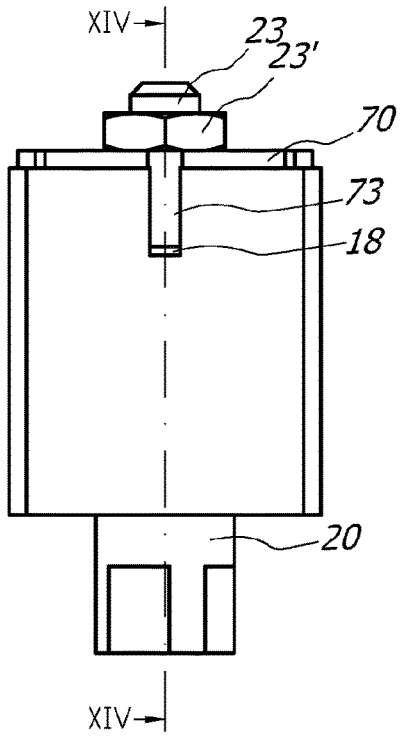
FIGS. 14 and 16 are front views of some elements of the hinge 1 comprising adjustment means 61 of the braking action in different operational steps.

In case that the counteracting element 70 is not united with the hinge body 10, as particularly shown in the FIGS. 18 and 19, the former may be coupled with the latter so as to be reciprocally rotationally blocked.

In particular, the counteracting element 70 may comprise some male elements 73, while the hinge body 10 may comprise corresponding female grooves 18 so as to prevent said rotation around the axis X.

Conveniently, the hinge 1 may also comprise at least one plunger element 50 slidable into the hinge body 10 as shown in the FIGS. 6, 7, 8, 9, 11, 20 and 21.

In particular, the pivot 20 and the plunger element 50 may be reciprocally configured so that the rotation of the former around the axis X corresponds to the sliding of the latter along the axis Y.

Figure 10:
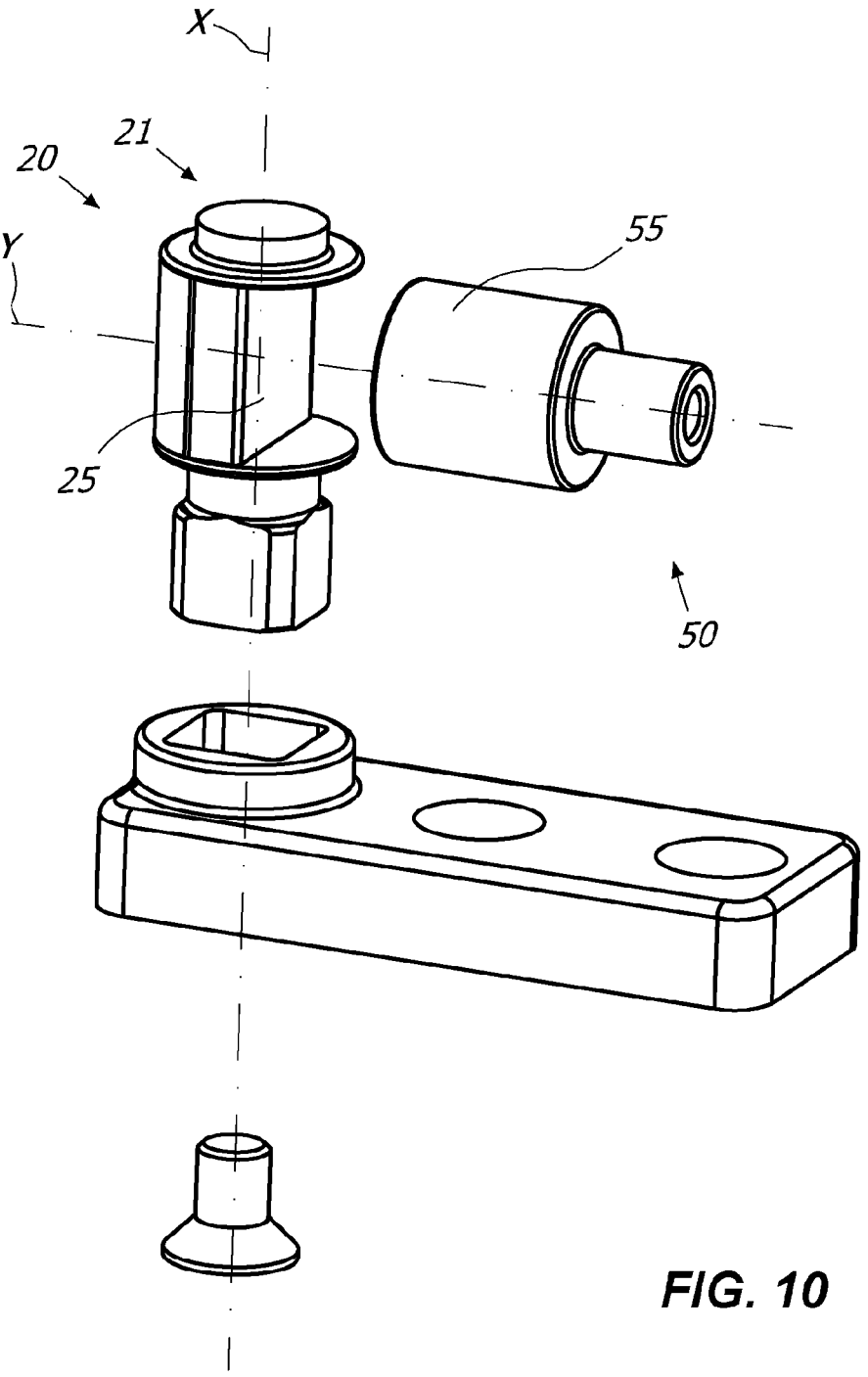
FIG. 10 is an exploded view of some elements of an embodiment of the hinge 1 in which the cam means 25 have a different configuration.

Conveniently, as shown in particular in FIG. 10, the pivot 20 may comprise cam means 25 rotating around axis X. Besides this, follower means 55 integrally coupled to the plunger element 50 may be foreseen, which may interact with the cam means 25 in order to move the plunger element 50 along the axis Y.

For example, as shown in the FIGS. 6 and 7, the cam means 25 may define a plane n, while the follower means 55 may define a plane n'. Conveniently, the cam means 25 and the follower means 55 may then be reciprocally configured so that when the pivot 20 is in closed position (FIG. 6), the planes $\pi$, $\pi'$ may be substantially parallel and when the pivot 20 is in open position (FIG. 7), the planes $\pi$, $\pi'$ may be substantially perpendicular.

It is understood that the cam means 25 and the follower means 55 may have any configuration. For example, the follower means 55 may have a substantially cylindrical section as shown in the FIGS. 10 and 12, or a substantially longitudinal section as shown in the FIGS. 8, 9 and 11.

Conveniently, the hinge 1 may then comprise at least one second working chamber 41 inside which the plunger element 50 may slide.

In particular, as shown in the embodiment shown in FIG. 8, the half-shell 6 may comprise a blind hole 43 defining said second working chamber 41.

Conveniently, said blind hole 43 may be opened in correspondence to the first working chamber 11 so that the half-shells 5, 6 couple with the plunger element 50 inserted in the second working chamber 41 and faced to the pivot 20.

In any case, the second working chamber 41 may comprise at least one inner surface 42 which may be made of an anti-friction material, preferably of the anti-friction polymeric material described above.

According to a particular aspect of the invention, all the hinge body 10 may be made of a single anti-friction material, preferably of the anti-friction material described above. In particular the hinge body 10 may be made for moulding of the latter.

In this way, the hinge body 10 may act as anti-friction means both for the pivot 20 and for the plunger element 50.

The hinge 1 may be of mechanical and/or hydraulic type.

For example, the hinge 1 of FIG. 11 may be a mechanical hinge, without oil or similar working fluid. In such case, the plunger element 50 may be moved by the elastic counteracting means 51, and the movement of the latter may be damped and/or braked by the braking means 60.

On the other side, the hinge 1 of the FIGS. 6, 7, 8, 9, 20 and 21 may be a hydraulic hinge, in which oil or a similar working fluid damps the movement of a plunger element 52, always moved by the elastic counteracting means 51.

According to the type of the elastic counteracting means 51, the hinge 1 may be a closing hinge, in which the elastic counteracting means 51 include a thrust spring 51', or a control hinge, in such case the elastic counteracting means 51 include one thrust spring 51'.

The plunger element 52 may be mobile along the axis Y between one first end stroke position and one second end stroke position. In particular, the plunger element 52 may be integral with the follower means 55 so that the first end stroke position (FIGS. 6 and 20) of the plunger element 52 may correspond to the closed position and the second end stroke position (FIG. 7) of the plunger element 52 may correspond to the open position.

Figure 20:
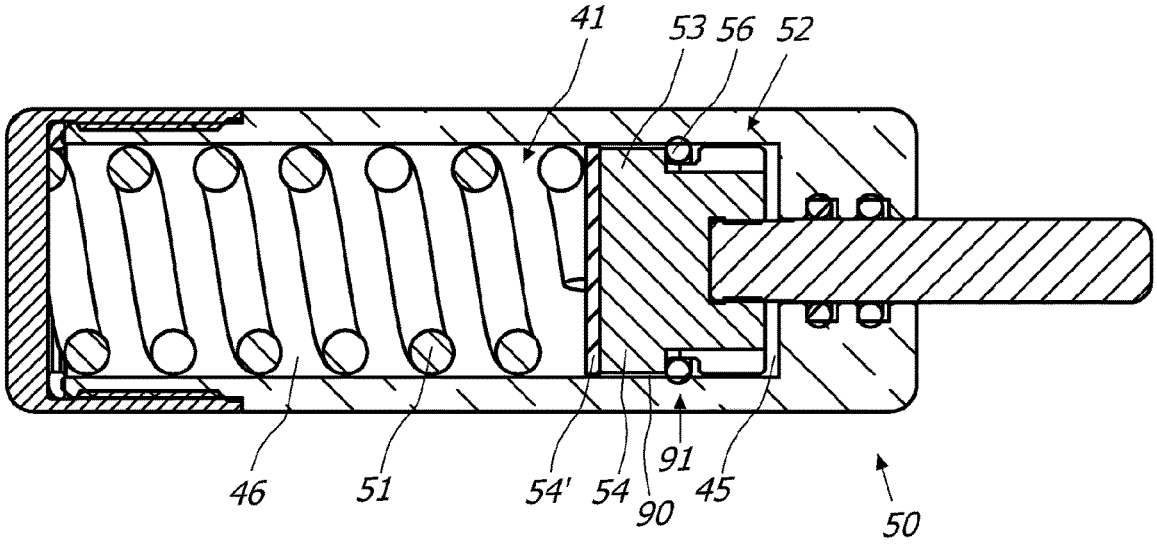
FIG. 20 is a section view of some elements of another embodiment of the hinge 1.
Figure 21:
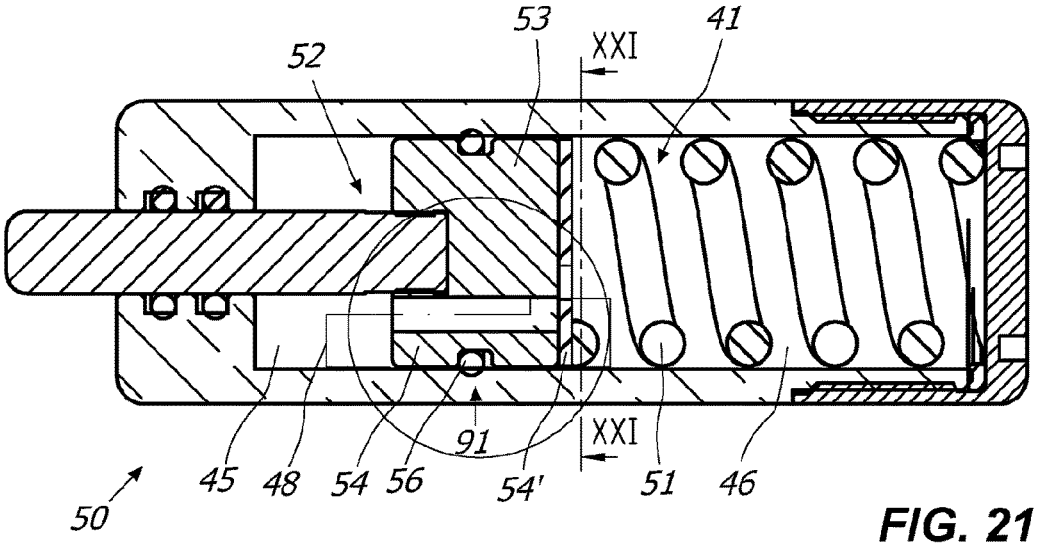
FIG. 21 is a section view of some elements of another embodiment of the hinge 1.

Possibly, as shown for example in the FIGS. 20 and 21, the elastic counteracting means 51 may interact with the plunger element 52 in order to bring it back from one between the first and second end stroke position to the other between the first and second end stroke position.

In particular, as shown in the FIGS. 20 and 21, the plunger element 52 may separate the second working chamber 41 in at least one first and one second variable volume compartments 45, 46 fluidically communicating each other and preferably adjacent.

Possibly, the plunger element 52 may be inserted so that it is leak-proof in the second working chamber 41. For such purpose, in a known way, the plunger element 52 may comprise, for example, at least one elastic sealing element, for example one elastic sealing element 56.

Conveniently, it may be foreseen at least one hydraulic circuit 48 to allow the passage of the working fluid from the first compartment 45 to the second compartment 46 during the closing of the closing element D, and from the second compartment 46 to the first compartment 45 during the opening thereof.

In particular, the plunger element 52 may comprise a cylinder 53 with a duct 80 therethrough to allow the passage of the working fluid from the first compartment 45 and the second compartment 46 during the movement of the closing element D.

Figure 22:
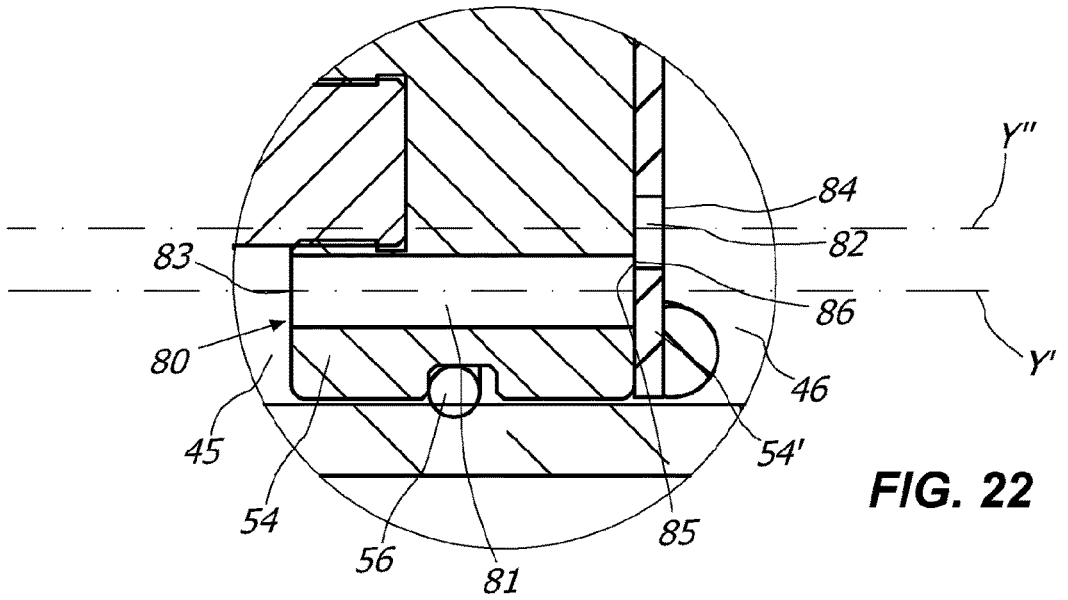
FIG. 22 is an enlarged view of some elements of FIG. 21.

According to a particular aspect of the invention, as shown in the FIGS. 20, 21 and 22, the cylinder 53 may comprise at least one first and one second portion 54, 54' integrally coupled each other.

In particular, the second portion 54' of the cylinder 53 may be one disk, while the first portion 54 may be a cylindrical element coaxial to said disk 54'.

Conveniently, the elastic counteracting means 51 may act on the disk 54' to push the latter against the first portion 54 so as to keep them rigidly coupled in the axial direction.

Even though not shown in the attached figures, it is understood that said portions 54, 54' may be monolithically coupled without departing from the protection scope of the present invention.

Advantageously, the duct 80 may comprise one calibrated light 57 for the passage of a controlled amount of the working fluid. In this way the flow rate of the fluid passing the calibrated light 57 may be particularly reduced.

In particular, each of the first and second portion 54, 54' may comprise a respective one and second section 81, 82 of the duct 80 which may define one respective axis Y', Y" substantially parallel to each other and to the axis Y.

Conveniently, the first and second portion 81, 82 of the duct 80 may comprise respective first ends 83, 84 facing the first and second variable volume compartment 45, 46 and opposed second ends 85, 86 each other reciprocally faced.

As particularly shown in FIG. 22, the axis Y' and the axis Y" may be staggered each other so that the second ends 85, 86 of the first and second section 81, 82 of the duct 80 may define the calibrated light 57 for the passage of a controlled quantity of working fluid.

More in detail, the second ends 85, 86 of the first and second section 81, 82 of the duct 80 are reciprocally in contact, so that the calibrated light 57 may be defined by the overlap, at least partial, thereof.

Figure 24:
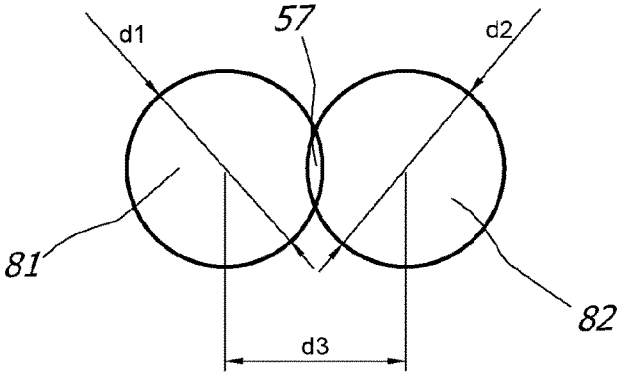
FIG. 24 is an enlarged schematic view of some elements of FIG. 23.
Figure 25:
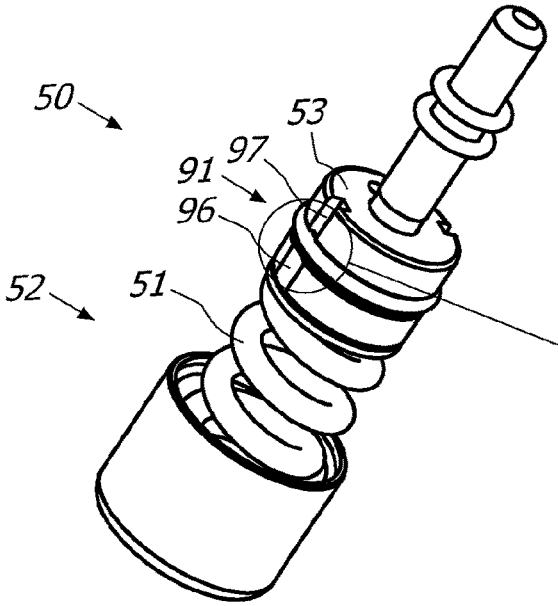
FIGS. 25 and 27 are axonometric views of some particulars of one plunger element 52 of the hinge 1 in different operational steps.
Figure 26:
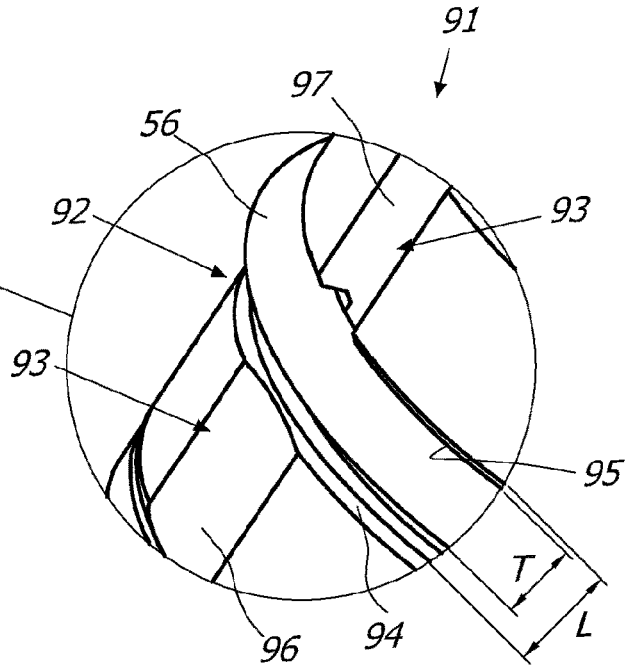
FIGS. 26 and 28 are enlarged views of some particulars respectively of FIG. 25 and FIG. 27.
Figure 27:
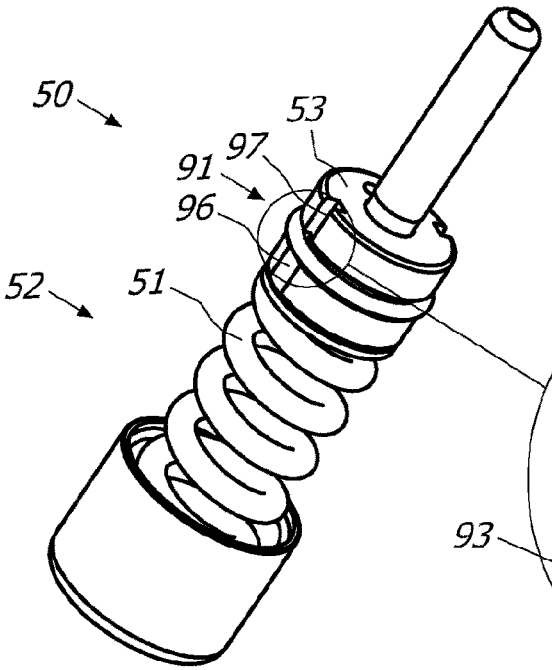
Figure 28:
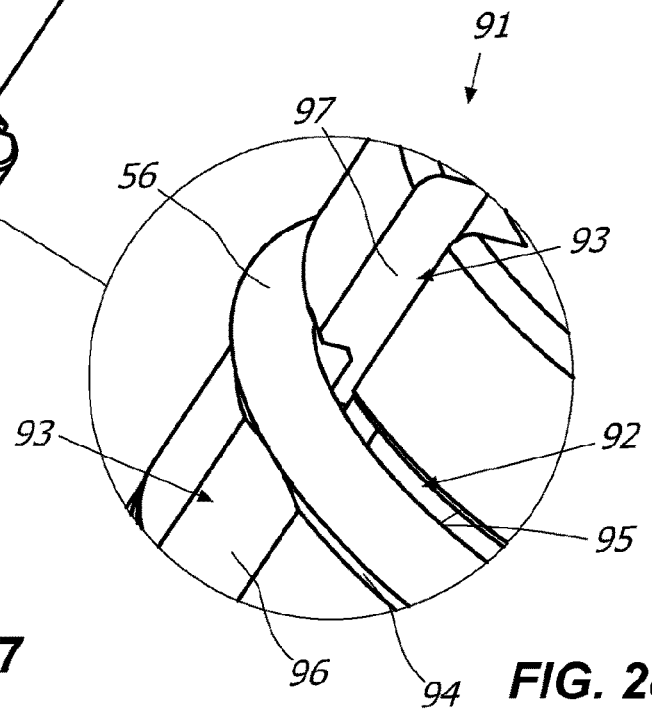

For example, as shown in FIG. 24 the second ends 85, 86 may each present one respective diameter d1, d2 which may be substantially equal to each other. Conveniently, said diameters d1, d2 may have a reciprocal distance d3 slightly lower than the same diameters d1, d2.

Besides this, the hinge 1 may comprise means for centering the coupling of the first and second portion 54, 54' of the cylinder 53 so that once coupled the respective second ends 85, 86 the calibrated light 57 of predetermined dimension is defined. Besides this, thanks to the centering means, the relative angular position of the latter may remain unchanged over time.

Figure 23:
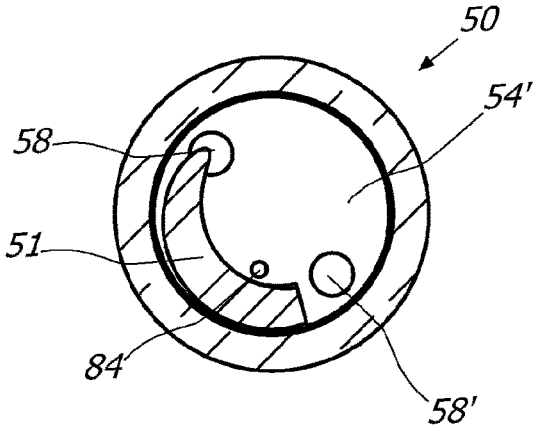
FIG. 23 is a section taken along the planes XXI-XXI in FIG. 21.

For example, as shown FIG. 23, said centering means may comprise a pair of rods 58, 58' protruding from the disk 54' susceptible to couple in corresponding seats of the first portion 54 of the cylinder 53.

According to a particular feature of the invention, another duct 90 may be foreseen for the passage of the working fluid between the first and the second compartment 45, 46. In particular, the duct 90 may comprise at least one non-return valve 91 which may be configured so as to allow the passage of the working fluid from the first and second compartment 45, 46 during one of the opening or the closing of the closing element D so as to prevent the passage during the other of the opening or the closing thereof.

In particular, the cylinder 53 may include one peripheral annular groove 92 and at least one axial channel 93 passing through the annular groove 92 itself.

Conveniently, as shown in the FIGS. 25, 26, 27 and 28, the elastic sealing element 56 may be inserted in the annular groove 92, and in particular, may be interposed between the annular groove 92 and the inner surface 42 of the second working chamber 41 so as to hydraulically seal the plunger element 52.

In particular, the annular groove 92, the axial channel 93 and the elastic sealing element 56 may be reciprocally configured so as to allow the passage of the working fluid between the first compartment 45 and the second compartment 46 during one of the opening or the closing of the closing element and to prevent the passage during the other of the opening or the closing thereof. In other words, they may define the non-return valve 91.

Figure 29:
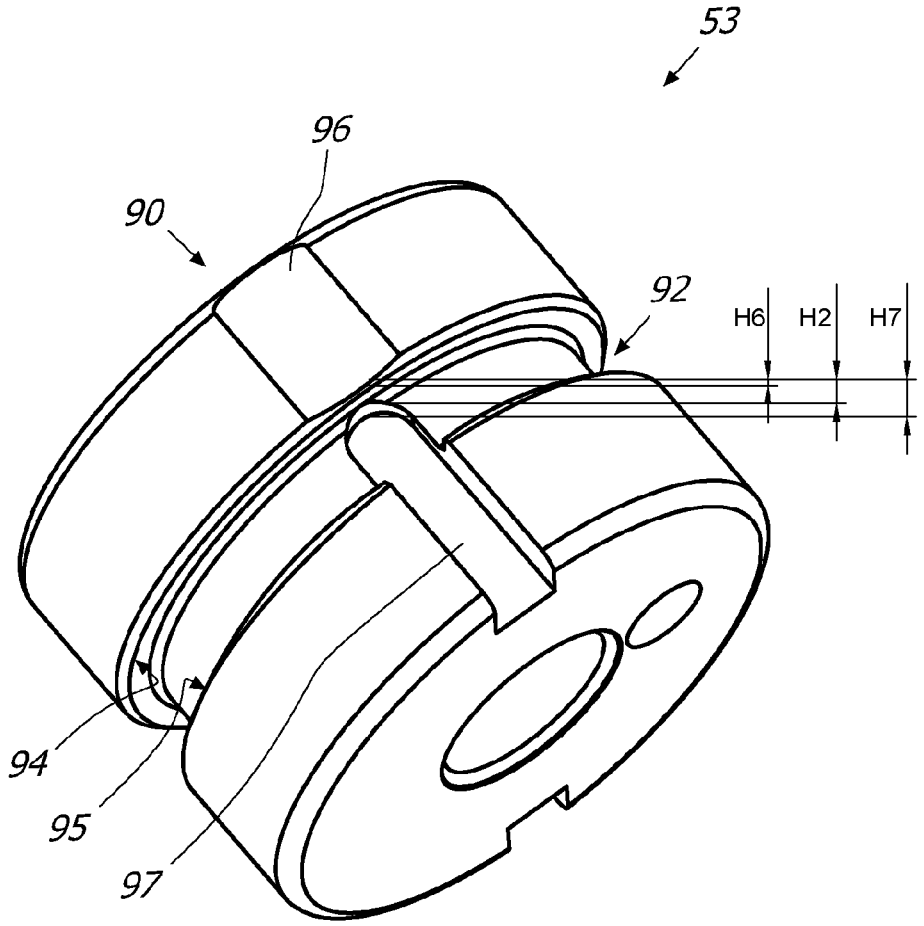
FIG. 29 is an axonometric view of some particulars of the plunger element 52.

More in detail, as shown in FIG. 29, the annular groove 92 may have a first abutment surface 94 and one second opposed abutment surface 95.

Conveniently, the annular groove 92 may have a width L substantially greater than the thickness T of the elastic sealing element 56 so that the latter may move between one first working position in which abuts against the first abutment surface 94 to prevent the passage of the working fluid and one second working position in which abuts against the abutment surface 95 to allow the passage of the working fluid.

In particular, the elastic sealing element 56 may be in contact with the groove 92 and the inner surface 42 of the second working chamber 41, so as the sliding of the plunger element 52 inside the second working chamber 41 promotes the movement of the elastic sealing element 56 between the first and the second working position.

The axial channel 93 may include one first passage portion and one second passage portion 96, 97 for the working fluid, which may be faced to the inner surface 42 of the second working chamber 41.

Conveniently, the annular groove 92 may be interposed between the first and the second passage portion 96, 97 and fluidically communicating therewith. The latter, besides this, may be placed in correspondence to respectively the first and the second abutment surface 94, 95.

The first and the second passage portion 96, 97, the elastic sealing element 56 and the annular groove 52 may then be reciprocally configured so that in the first working position, the elastic sealing element 56 may act against the first passage portion 96 so as to close the fluidic communication with the annular groove 92 and so that in the second working position, the elastic sealing element 56 itself may be distanced from the first passage portion 96 to open the fluidic communication with the annular groove 92 so as to allow the passage of the working fluid in the second passage portion 97.

In particular, as shown in FIG. 29, the second passage portion 97 may have a depth H7 greater than the depth H2 of the annular groove 92 while the first passage portion 96 may have a depth H6 substantially lower than the latter.

The invention is susceptible of numerous modifications and variations, without departing from the scope of the appended claims. All the details may be replaced with other technically equivalent elements, and the materials may be different according to requirements, without departing from the scope of the invention defined in the appended claims.

The invention claimed is:

1. A hinge for rotatable movement or control during opening or closing of a closing element anchored to a stationary support structure, the hinge comprising:

a fixed element anchorable to the stationary support structure; and a movable element anchorable to the closing element, the movable element and the fixed element being reciprocally coupled to rotate around a first longitudinal axis between an open position and a closed position, wherein one of the fixed element or movable element comprises a pivot defining the first axis or an axis parallel thereto, the pivot being anchorable to one of the stationary support structure or the closing element, wherein the other one of the fixed element or movable element comprises a hinge body defining a second axis essentially perpendicular to the first axis, the hinge body being anchorable to the other one of the stationary support structure and the closing element, the pivot and the hinge body being reciprocally coupled so that the closing element rotates between the one open position and the closed position, and wherein the hinge body includes a first working chamber housing the pivot; and a pair of half-shells coupled to each other, one half-shell including a first half-portion of the first working chamber and the other half-shell including a second half-portion of the working chamber, the hinge being assembled by coupling the pair of half-shells with the pivot interposed between the first half-portion and the second half-portion of the first working chamber, the pair of half-shells being coupled by sliding along the second axis.

2. The hinge according to claim 1, wherein the first working chamber includes an inner surface comprising a first support portion made from a first anti-friction polymeric material, the first support portion being configured to be loaded by the pivot.

3. The hinge according to claim 2, wherein the inner surface of the first working chamber further includes a second support portion configured to be loaded by the pivot and disposed opposite to the first support portion, the second support portion being made from a second anti-friction polymeric material.

4. The hinge according to claim 3, wherein the first and the second anti-friction polymeric material are a single anti-friction polymeric material, all the inner surface of the first working chamber being made from the single anti-friction polymeric material.

5. The hinge according to claim 4, wherein at least one of the first anti-friction polymeric material, the second anti-friction polymeric material, or the single anti-friction polymeric material is a thermoplastic polymer.

6. The hinge according to claim 4, wherein at least one of the first anti-friction polymeric material, the second anti-friction polymeric material, or the single polymeric material is an anti-friction self-lubricating polymeric material.

7. The hinge according to claim 4, wherein at least one of the first anti-friction polymeric material, the second anti-friction polymeric material, or the single polymeric material is a fiber-filled polyamide material with a solid lubricant additive.

8. The hinge according to claim 4, wherein one of the half-shells comprises a second working chamber defining the second axis and a plunger element slidable into the second working chamber to interact with the pivot.

9. The hinge according to claim 8, wherein the second working chamber is defined by a blind hole in the one of the half-shells, the blind hole being open at the first working chamber.

10. The hinge according to claim 9, wherein, upon coupling the pair of half-shells, the plunger element is inserted into the second working chamber and is facing the pivot.

11. The hinge according to claim 4, wherein all of the hinge body is made of the single anti-friction polymeric material.

12. The hinge according to claim 11, wherein the hinge body is configured to operate as an anti-friction device for the pivot.

13. The hinge according to claim 11, wherein the hinge body is configured to operate as an anti-friction device for the plunger element.

14. The hinge according to claim 1, wherein the rotatable movement of the closing element is controlled.

15. The hinge according to claim 1, further including a brake that brakes the rotatable movement of the closing element upon the opening or the closing thereof.

* * * * *